United States Patent [19]

Jergenson et al.

[11] Patent Number: 4,752,692

[45] Date of Patent: Jun. 21, 1988

[54] LIQUID METAL ION SOURCE

[75] Inventors: Jerg B. Jergenson, Santa Barbara, Calif.; Charles M. McKenna, Boxford, Mass.

[73] Assignee: Hughes Aircraft Company, Los Angeles, Calif.

[21] Appl. No.: 727,701

[22] Filed: Apr. 26, 1985

[51] Int. Cl.[4] ..... H01J 27/02

[52] U.S. Cl. ..... 250/423 R; 250/425; 313/232; 313/362.1; 315/111.81

[58] Field of Search ..... 250/423 R, 423 F, 424, 250/425; 313/230, 231, 232, 362.1, 163; 315/111.81

[56] References Cited

U.S. PATENT DOCUMENTS 4,318,029 3/1982 Jergensen ..... 250/423 R
4,318,030 3/1982 Jergensen ..... 250/423 R

FOREIGN PATENT DOCUMENTS 3404626 9/1984 Fed. Rep. of Germany ... 250/423 R

OTHER PUBLICATIONS

Prewett et al.; "Liquid Metal Source of Gold Ions," Dev. Sci. Insts. 52(4), Apr. 1981.

*Primary Examiner*—Craig E. Church
*Assistant Examiner*—Paul A. Guss
*Attorney, Agent, or Firm*—Wanda K. Denson-Low; A. W. Karambelas

[57] ABSTRACT

U-shaped billet (52) has a slot (54) cut therein for receipt of a slip of insulator material (56). This body is machined on its front end (64) to produce a narrow bridge (66) of controlled cross-sectional area. Emitter needle (78) is positioned in a bore through the bridge to be heated by current through the bridge. The ion emitter body is rigid and strong to hold the emitter needle in the proper location.

6 Claims, 3 Drawing Sheets

LIQUID METAL ION SOURCE

This invention was made pursuant to Government Contract No. 81F-597000. Therefore, the Government has rights in this invention.

BACKGROUND OF THE INVENTION

This invention is directed to a field emission liquid metal ion source which has a point which is resistively heated and which is coated with liquid metal to emit ions.

The first liquid metal ion source described in the literature was designed and developed by Clampitt at Culham Laboratories in England. It is shown in U.K. patent No. 1,442,998. Subsequently to that publication, Culham Laboratories marketed liquid metal ion sources of the same general configuration intended for producing ions of copper, silver, gold, bizmuth, lead, tin, indium, gallium, uranium, mercury, silicon, germanium, iron, aluminum, lithium, sodium, potassium, rubidium, and cesium. In the United States, Dublier Scientific marketed a similar liquid metal ion source, and it is believed that all Dublier Scientific sources were made of refractory metals. The early sources with low melting point fuels were radiatively heated via a simple external coil. Later, the sources were oven heated for use with higher melting point materials.

The gas field ionization "hairpin" ion source was originally designed for gas field emission. The heart of the hairpin device is a U-shaped heater wire with a needle welded to the apex of the U. The heater wire is used to clean the attached needle by heating it to cause outgassing. When used with liquid metal, the hairpin ion source works fairly well with non-corrosive fuel materials. L. W. Swanson first used the device as a liquid metal source by applying liquid metal directly to the needle. A number of drawbacks are found. The hairpin device is difficult to make, due to the necessary welding of the needle to the U-shaped heater wire. Since the needle is mounted on the heater wire and the heater wire is employed for structural support of the needle, the ion source lacks stability in the direction perpendicular to the plane of the U-shaped heater wire when the heater wire is heated. In addition, the hairpin source is thermally inefficient and has a poor temperature gradient.

Advances in liquid metal ion sources have been made at Hughes Research Laboratories division of Hughes Aircraft Company. On behalf of Hughes Research Laboratories, Jerg B. Jergenson invented the structures represented in U.S. Pat. Nos. 4,318,029 and 4,318,030. These sources are easy to make, inexpensive and reliable. As a result, considerable advances in the employment of ions from a liquid metal source have been achieved. Ions have been produced from fuel alloys. However, it soon became evident that alloys containing boron attacked the metallic source components used in the construction of the sources illustrated in those U.S. patents. When such liquid metal ion sources are made of non-metallic materials, they are difficult if not impossible to make. In addition, the needle may be inefficiently heated and the required temperature gradient may not be achieved when the source structure is made of non-metallic materials.

Boron is one of the most important doping elements for silicon devices. However, fabrication of a metal liquid metal ion source for utilization of liquid boron has been impractical due to the high melting point of metallic boron and the strong corrosive effect of the boron on most metals. To decrease the problems associated with the high melting point of metallic boron, a rhenium needle and eutectic alloys containing boron have been used. However, the lifetime of some sources employing boron containing eutectic alloys have been restricted to about 10–15 hours due to the corrosion of the rhenium emitters.

One group in Japan has attempted to find a boron containing alloy which is non-corrosive, but substantial lifetimes have not found. See "Liquid Metal Alloy Ion Sources for B,Sb, and Si," by K. Gamo, published in *Journal of Vacuum Science Technology,* Volume 19, No. 9, November/December 1981, pages 1182–1185. Further development work in Japan uses previously developed glassy carbon emitters for liquid metal ion sources and has used such sources with nickel boride as a fuel material. A lifetime of 200 hours for this type of source has recently been quoted. However, it has been admitted that the nickel constituent of the nickel boron alloy corrodes the emitter tip. Such sources have been used as an ion source in a mass-separating column for ion implantation. This is discussed in a publication "Mass-Separated Microbeam System with a Liquid-Metal-Ion Source," by T. Ishitani, et al. published in *Nuclear Instruments and Methods in Physical Research,* Volume 218 (1983) pages 363–367. The entire disclosure of this background material is incorporated herein by this reference.

The ion source is a very small and delicate structure. Furthermore, the emission point must be as positively located as possible in order to maintain adequate alignment of the emitted ion beam. Thus, there is a need for an improved field emission liquid metal ion source.

SUMMARY OF THE INVENTION

In order to aid in the understanding of this invention, it can be stated in essentially summary form that it is directed to a liquid metal ion source wherein a field emission point is positioned on an electrically conductive or semi-conductive material which is slotted together with a non-conductive material positioned within the slot. The conductive material is continuous around the slot at the nose end of the body, and the nose end is configured to conduct heating current and withdraw heat therefrom in order to maintain optimum emitter conditions.

It is, thus, a purpose and advantage of this invention to provide a liquid metal ion source which relies on a field emission sharp point to cause ion emission into an electric field, with the point being on a slotted body so that the body supplies a support for the point, electrical path for heating the point, electrical separation to provide the electrical path and firm physical support of the point so that it may be readily held in position.

It is a further purpose and advantage to provide a liquid metal ion source of field emission type which is economic of construction as well as of strong construction so that it may be easily manufactured, readily available, and conveniently used, even though it is of small dimensions.

Other purposes and advantages of this invention will become apparent from a study of the following portions of the specification, the claims and the attached drawings.

DESCRIPTION OF THE PREFERRED EMBODIMENT

Figure 1:
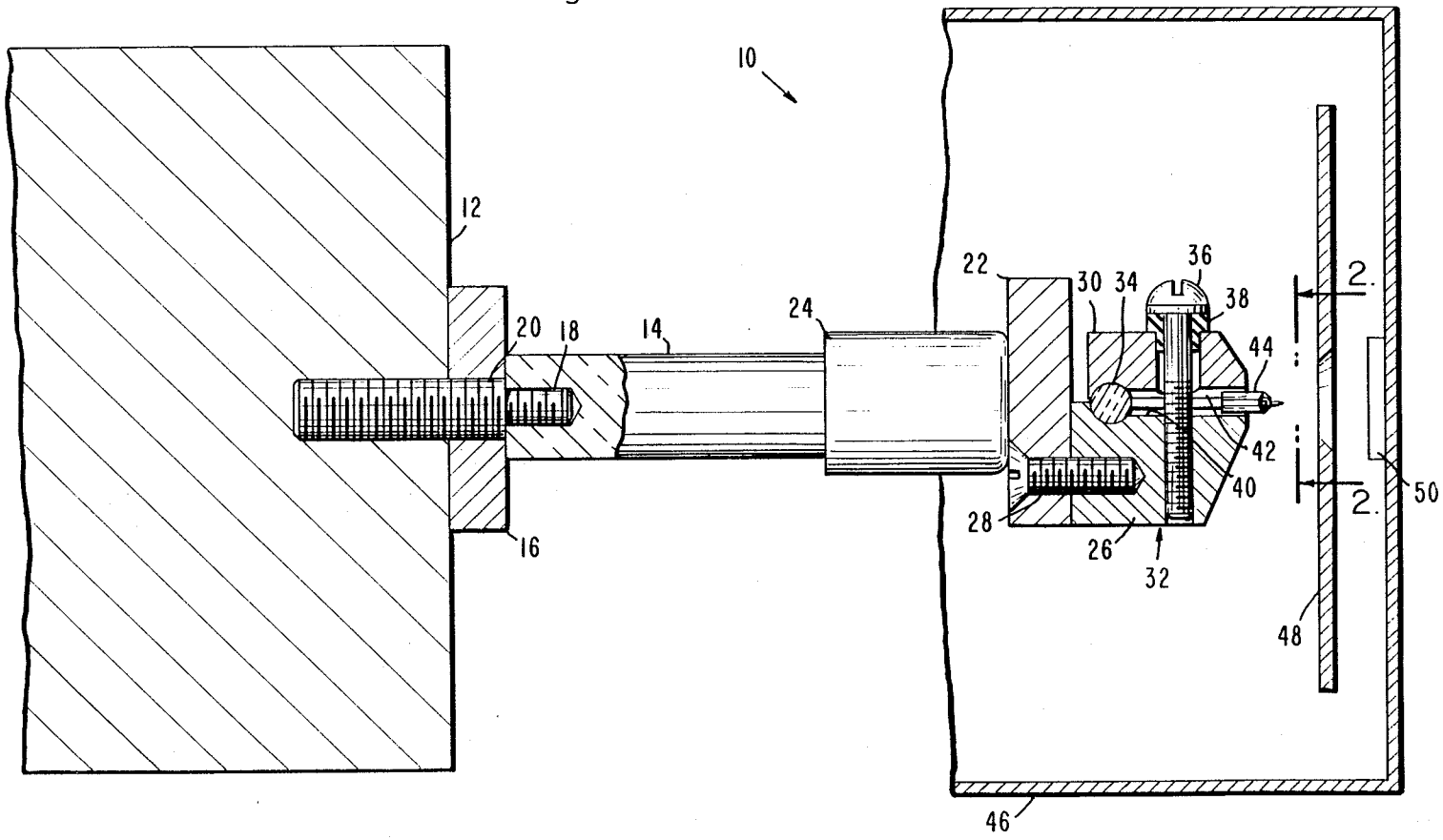
FIG. 1 is a side-elevational view of an ion system which includes the liquid metal ion source of this invention, with parts taken in section and parts broken away.

The ion emitter 44 is shown in detail in FIGS. 2, 3, and 4, and is described in detail below. The ion emitter must be supported in a holder which properly physically positions the emitter over a range of temperatures. In addition, the emitter must be supplied with heater current and bias voltage so that electrical connections are also made to the ion emitter. However, the emitter holder and electrical connections must not provide a thermal load which interferes with the thermal property of the emitter itself. FIG. 1 illustrates a particular holder for a liquid metal ion source 10 which serves as an example of a particular module holder. This holder forms no part of this invention, but is depicted here merely in the context of showing one (out of many) way in which the ion emitter of the invention may be held in position.

Mounting base 12 is part of the liquid metal ion column. Ceramic insulator stand 14 is secured to mounting base 12 through foot 16. Screw 18 secures insulating stand 14 on foot 16, while screw 20 (which has its head broken away in FIG. 1) secures foot 16 to base 12. One, two or three insulator stands may be provided so that clamp base 22 is securely and rigidly mounted. Appropriate screws pass from right to left through clamp base 22 into the insulator stand 14 to provide security. A cup-shaped metallic sputter shield 24 may embrace the right end of insulator stand 14, as shown. In the example shown, clamp base 22 is metallic, as is fixed jaw 26. Screw 28 mounts the fixed jaw to clamp base 22.

Movable jaw 30 of body carrier 32 swings with respect to fixed jaw 26 on pivot 34. Pivot 34 is a cylindrical ceramic pin which lies in partially cylindrical recesses in both jaws, with the axis of the surfaces of the recesses perpendicular to the sheet in FIG. 1. Clamp screw 36 is metallic, but has insulator washer 38 under its head. The washer is preferably ceramic. In this way, movable jaw 30 is electrically isolated with respect to fixed jaw 26. Longitudinal groove 40 extends left to right in FIG. 1 and faces upward in the top of fixed jaw 26. Similarly, longitudinal groove 42 is positioned in the lower surface of movable jaw 30 and faces groove 40. The ion-emitting body 44 of this invention is located in those grooves and is clamped by those jaws. The body itself is indicated in more detail in FIGS. 2, 3 and 4 described below.

Should it be thought desirable to reduce the thermal load of the mounting structure 32 on the emitter 42, appropriate engineering choices can be made to reduce the thermal loading. This would include reduction and mass of the mounting structure, increase in thermal resistivity of the mounting structure, and minimization of the mass of the electrical connections. For example, this same general structure could be made of ceramic of high thermal resistivity with just the jaw faces plated for electrical connection. Reduction in mass of the jaw parts and restriction on the thermal path would permit the source to more quickly reach thermal stabilization. Thus, the structure described above and shown in FIG. 1 is one way in which the source module can be supported, and improved support and electrical connection structure may be developed in the future to support the ion emitting body 44 of this invention. In any event, the jaws must be symmetrical. Heat must be conducted away from the source module/jaw interface or else the required temperature gradient across the tip of the module cannot be achieved.

The liquid metal ion source 10, with its ion-emitting body 44, is mounted in a vacuum vessel 46 which contains extractor electrode 48. Various types of downstream ion optics can be provided for focusing and/or directing the beam. In the present case, an ion flood is directed toward target 50 which is positioned beyond the central opening in the extractor electrode. The target 50 may be any ion beam utilization device. In other types of ion utilization, focusing may be required.

Figure 2:
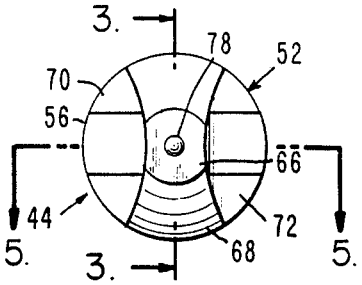
FIG. 2 is an enlarged front-elevational view of the body of the ion source of this invention, as seen along the line 2—2 of FIG. 1.
Figure 4:
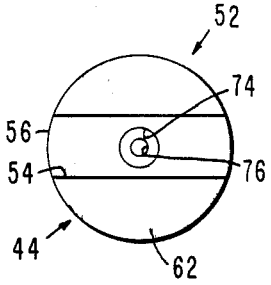
FIG. 4 is a rear-elevational view of the ion source of this invention.
Figure 3:
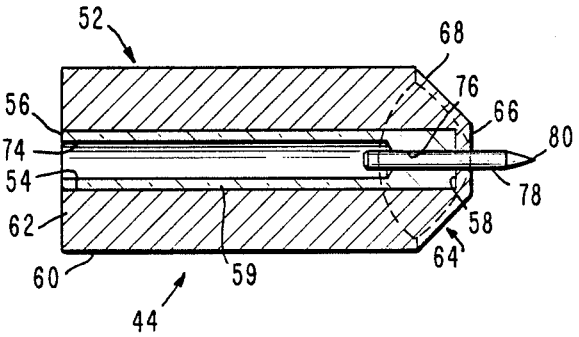
FIG. 3 is a center line section through the body of the ion source as seen generally along the line 3—3 of FIG. 2.
Figure 5:
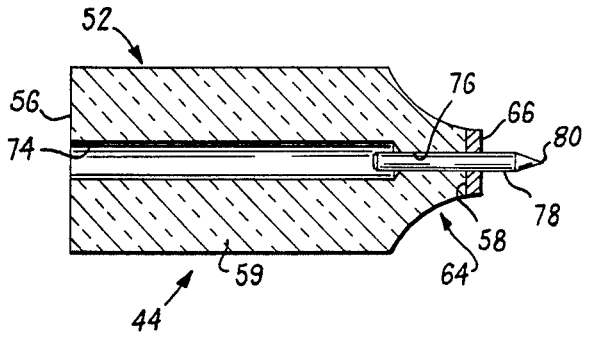
FIG. 5 is a center line section through the body of of the ion source as seen generally along the line 5—5 of FIG. 2.

The ion-emitting body 44 which is shown in more detail in FIGS. 2, 3 and 4 is composed of two structural elements. Its structure can be best understood by describing the method in which it is made. A billet of the principal material is provided. This principal material is a conductive or semi-conductive material of preferably low thermal coefficient of expansion. In the present preferred embodiment, graphite is used. Other suitable materials for the principal material include boron carbide, boron enriched boron carbide, glassy carbon, titanium diboride, and zirconium diboride. These materials should resist corrosion by the fuel material. This cylindrical billet is generally indicated at 52. Rectangular slot 54 is formed longitudinally and exactly on axis in the billet, but does not reach the end of the billet, which at this stage of manufacture extends well beyond the tip shown in FIG. 3. Slot face 56 defines the end of the slot. The purpose of the slot is to form the billet into a U-shaped structure having a narrow electrical path at the face of the body. A slip of insulator 59 is to retain the walls of the slot in spaced condition, both for further machining and during final use. With the insulator slip in place, the billet can be clamped in a chuck for machining. The slip of insulator material 59 may be held in place by any suitable adhesive during the machining operations. A low-volume adhesive such as cyanoacrylate is preferred.

The first operation is to clamp one end of the billet, the right end seen in FIG. 3, in a chuck and to machine the exterior surface 60 and the back end 62, as well as the protruding edges of the dielectric slip, to a suitable configuration. The body configuration is preferably symmetrical. A suitable configuration which is easy to machine is a cylindrical exterior surface 60 and a flat back end. When the material is graphite, the surfaces can be turned with high speed tooling. With harder materials, diamond grinding may be necessary for the finishing of the ion emitter body 44. Next, the body is reversed in the chuck and the exterior surface 60 may be further ground towards the front or emitter end 64 of the body. The machining is configured to provide a narrow bridge 66 of conductive billet material from above the slip of insulator material 59 to below it. As is best seen in FIGS. 2 and 3, from the face 58 of the slot to the front of bridge 66, only a small amount of material is left. In addition, conical surface 68 is machined on the front end of the body to further define the bridge. Such a configuration is satisfactory to provide the restricted cross-sectional area of the bridge, but further restriction can also be provided. FIG. 2 illustrates surfaces 70 and 72 which are in the form of parts of cylindrical surfaces. In this case, the axes of the cylindrical surfaces are upright in FIG. 2, normal to the slot. The intersection of the cylindrical surface with the conical surface 68 presents the curved intersection shown in FIG. 2 and shown in dotted lines in FIG. 3. The provision of the cylindrical surfaces cuts away material of the billet from the bridge and removes the insulative material from the immediate vicinity of the emitter needle.

During the machining of the body, bore 74 is provided along the axis of the body towards the emitter end of the body. This bore is provided so that a temperature-sensing thermocouple may be placed close to the bridge. In addition, smaller bore 76 is provided through the slip of insulator material towards the face of the slot and through the bridge 66. Emitter needle 78 having emitter point 80 is pressed or otherwise secured into bore 76 and is heated by thermal conductivity from the bridge and the insulator material adjacent the face of the slot. The emitter needle 78 is of a material selected in accordance with the metal or metal alloy which provides the material being ionized. An optimum material may be glassy carbon or graphite when the desired ion is boron. Other suitable materials include boron carbide, boron enriched boron carbide, titanium diboride and zirconium diboride. The ion emiter 44 with its needle 78 provides a substantial reservoir of fuel alloy material. Fuels may include boron platinum alloy, preferably near the eutectic, boron platinum, nickel boride, arsenic palladium and palladium arsenic boron. For a long-life emiter, the emitter materials are chosen with respect to the fuel alloy such that corrosion and alloying between them is minimized. The emitter can be reused upon exhaustion of the fuel material by refueling the needle. The heating of the needle 78 is dominated by the contact resistance between the unwetted bridge 66 and the needle such that the heating is relatively localized near the emitter needle.

The completed ion emitter 44 with its needle 78 is placed in the clamp jaws of FIG. 1, with the slip of insulator material oriented normal to the plane of the drawing of FIG. 1 so that one jaw engages the body below the insulator material and the other jaw engages it above the insulator material. The jaws are suitably electrically connected to provide heating current and emitter bias voltage.

The heating current passes from the upper portion to the lower portion of the emitter body through the bridge 66. The cross section of the bridge, at right angles to the average current flow, can be diminished in accordance with the requirements of temperature, bridge material and heater current. Some of the heat thus produced is directly conducted to the emitter needle 78. Other heat is conducted to the forward end of the insulator slip where it is conducted to the emitter needle. In this way, the heating is relatively localized for efficient heating.

When placed in use, the body 44 is cleaned by heating in vacuum. If desired, a pretreatment of the needle can be accomplished to enhance its wettability with the fuel material. This can be performed on the needle 78 independent of the main part of the body. The use of a separate emitter needle permits this separate pretreatment and permits the selection of an emitter needle based on its ability to be wet by the fuel metal or alloy without substantial attack. Furthermore, the material of the emitter needle can be selected so that it may be formed into proper needle structures by chemical or mechanical polishing or etching. The selection of needle materials is broadened because no complex machining is necessary, which permits selection of materials such as glassy carbon and the borides, e.g., titanium diboride, zirconium diboride and lanthanum hexaboride, which may be very difficult to machine. The use of a separate emitter needle 78 which is inserted into an ion emitter body as described permits a broad selection of materials for an ion emitter body which positively locates and secures the emitter needle point in place for ion source location stability.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An ion emitter, comprising:

a U-shaped body of electrically conductive or semiconductive material, said U-shaped body having substantially parallel legs which are joined at the front end of said body by a bridge;

insulator material positioned between the legs of said body so that said legs can be clamped together to compress said insulator material; and a needle positioned in an opening through said bridge so that when electric current is passed through said bridge, said needle is heated and when said needle is coated and biased, said needle emits ions, and wherein the front edge of said body is partly formed into a substantially conical surface which intersects said insulator material to limit said bridge of body material to a location adjacent said needle, and wherein said bridge has a front face which is the frustum of said conical surface and said needle lies substantially on the axis of said conical surface, and further wherein said front edge of said body carries portions of cylindrical surfaces intersecting with said conical surface surface to further limit the size of said bridge.

2. The ion source of claim 1 wherein the axes of said cylindrical surfaces are generally parallel to the direction of heating current through said bridge and substantially normal to the slot between said legs which contain said insulator material.

3. The ion source of claim 1 wherein said bridge has a smaller cross-sectional area in a direction generally at right angles to heating current flow than said legs.

4. The ion source of claim 3 wherein said emitter needle is made of a different material than said U-shaped body.

5. The ion source of claim 1 wherein there is a bore within said insulator material extending towards said bridge for the positioning of a temperature sensor within said bore for sensing temperature adjacent said bridge.

6. An ion source, comprising:

first and second facing jaws, said jaws having at least one clamp groove therein for the containment of an ion emitter body, said jaws being for connection to a source of current for heating the ion emitter body and a source of bias voltage for biasing the ion emitter to emit ions;

a vacuum chamber around said ion source, with a target holder in said vacuum chamber for carrying a target positioned in line with the ion source;

an accelerator electrode within said vacuum chamber in line between said ion source and said target for accelerating ions from the ion source to the target;

an ion emitter body positioned within said clamp jaws, said ion emitter body being generally U-shaped having parallel legs and having insulator material between said legs, said jaws engaging on separate legs so as to firmly retain said ion emitter body in position and facing said accelerator electrode, a bridge on said ion emitter body connected between said legs, said legs and said bridge being formed of a single structural piece of electrically conductive or semi-conductive material, wherein said ion emitter body has a truncated conical front end with said emitter needle positioned on the axis of said conical front end and extending from the truncated surface thereof, and wherein the front end of said emitter body carries cylindrical surfaces on opposite sides of said needle to restrict current flow to a path through said bridge closely adjacent said needle and to remove the insulative material from the immediate vicinity of the needle; and an emitter needle secured in an opening in said bridge so that said emitter needle can carry ionizable material and be heated by electric current flowing through said bridge so that said emitter needle is firmly positioned and directly heated.

* * * * *